US005487369A

United States Patent [19]

Hara et al.

[11] Patent Number: 5,487,369

[45] Date of Patent: Jan. 30, 1996

[54] EVAPORATIVE EMISSION CONTROL SYSTEM FOR INTERNAL COMBUSTION ENGINES

[75] Inventors: Takeshi Hara; Kouichi Hidano; Teruo Wakashiro; Kazumi Yamazaki, all of Wako; Tomoyuki Kawakami, Tochigi, all of Japan

[73] Assignee: Honda Giken Kogyo Kabushiki Kaisha, Tokyo, Japan

[21] Appl. No.: 338,218

[22] Filed: Nov. 9, 1994

[30] Foreign Application Priority Data

Nov. 9, 1993 [JP] Japan ..... 5-304667

[51] Int. Cl.[6] ..... F02M 33/02

[52] U.S. Cl. ..... 123/520; 123/198 D

[58] Field of Search ..... 123/520, 521, 123/518, 519, 516, 198 D

[56] References Cited

U.S. PATENT DOCUMENTS

| | | | |
|---|---|---|---|
| 4,836,172 | 6/1989 | Haruta | 123/520 |
| 4,951,643 | 8/1990 | Sato | 123/520 |
| 5,170,765 | 12/1992 | Hoshino | 123/520 |
| 5,174,265 | 12/1992 | Seikine | 123/520 |
| 5,209,210 | 5/1993 | Ikeda | 123/520 |
| 5,361,743 | 11/1994 | Denz | 123/520 |

FOREIGN PATENT DOCUMENTS 1-159455 6/1989 Japan .

*Primary Examiner*—Carl S. Miller

*Attorney, Agent, or Firm*—Nikaido, Marmelstein, Murray & Oram

[57] ABSTRACT

An evaporative emission control system for an internal combustion engine includes a canister for adsorbing evaporative fuel generated in the fuel tank, a communication passage connecting between first and second adsorbent chambers defined in the canister, a first introducing passage for introducing the generated evaporative fuel into the canister on an occasion other than at fueling, a purging passage for purging the evaporative fuel adsorbed into the canister to the intake passage, and an air-inlet passage communicating with the atmosphere. The first introducing passage, the second air-inlet passage and the purging passage are connected to the first adsorbent chamber. A second introducing passage is connected to the second adsorbent chamber, for introducing the evaporative fuel thereinto at refueling, and an additional passage having a cross sectional area larger than that of the air-inlet passage and communicating with the atmosphere is connected to the first adsorbent chamber. A first valve is arranged across the air-inlet passage, for closing the same at refueling, and a second valve across the additional passage, for opening the same at refueling.

7 Claims, 4 Drawing Sheets

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for internal combustion engines, which prevents emission of evaporative fuel generated in a fuel tank of the engine into the atmosphere.

2. Prior Art

An evaporative emission control system of this kind has been proposed, e.g. by Japanese Provisional Patent Publication (Kokai) No. 1-159455, which includes not only an ordinary canister which adsorbs evaporative fuel generated in a fuel tank of the engine during parking of a vehicle in which the engine is installed or during operation of the engine, but also a canister for exclusive use at refueling, which adsorbs evaporative fuel generated during refueling into the fuel tank. According to the proposed evaporative emission control system, to overcome the disadvantage with conventional canisters that they have an insufficient adsorbing efficiency due to a high flow velocity of evaporative fuel generated during refueling, the canister for exclusive use at refueling has a plurality of layers of adsorbents formed of activated carbon defined therein by one or more partitions, wherein the flow path of evaporative fuel is deflected so as to enhance the adsorbing efficiency without increasing the size (ratio L/D (length/diameter)) of the canister.

Further, it is known that if a large amount of HC molecules, as one of component elements of fuel, remain adsorbed by an adsorbent in the canister, an equilibrium adsorption phenomenon occurs in the canister, which is caused by movement of HC molecules such that the concentration of HC molecules becomes homogeneous throughout the canister, according to a change in the temperature of the canister with the lapse of time. To prevent this equilibrium adsorption phenomenon, an evaporative emission control system has been proposed, which includes a canister, the interior of which is divided into two activated carbon chambers, one for use in purging/charging, and the other for use in draining into the atmosphere, and a passage communicating between the two chambers, such that the interior of the canister has a generally U-shaped construction. In addition, this proposed evaporative emission control system is designed such that the volumetric size of the activated carbon chamber for purging/charging is larger than that of the activated carbon chamber for draining, whereby, during purging, the concentration of HC within the activated carbon chamber for purging/charging is reduced to a value lower than that of HC concentration within the activated carbon chamber for draining. As a result, occurrence of the equilibrium adsorption phenomenon can be restrained, leading to effective adsorption of the HC component to the activated carbon and hence preventing the HC component from passing through the canister without being adsorbed thereby.

In the former proposed evaporative emission control system, however, the canister for exclusive use at refueling is not used on occasions other than refueling, and becomes empty after evaporative fuel adsorbed therein is discharged or purged into the engine. Thus, the utilization factor of the activated carbon is low. Further, two batches of activated carbon have to be provided as adsorbents, one for the canister for exclusive use at refueling, and the other for the ordinary operation, leading to use of a large amount of activated carbon and hence an increased cost. Moreover, at least two purging passages connecting between the respective canisters and the intake passage of the engine have to be provided to discharge evaporative fuel adsorbed by the canisters, resulting in that the evaporative emission control system has a complicated construction.

On the other hand, in the latter proposed evaporative emission control system, since evaporative fuel (HC component) is generated in a large amount during refueling, it is impossible for the single canister to adsorb evaporative fuel generated during refueling and during stoppage of the engine. Therefore, a canister with a further improved adsorbing capacity is desired.

SUMMARY OF THE INVENTION

It is an object of the invention to provide an evaporative emission control system for internal combustion engines, which is capable of enhancing the utilization factor of adsorbents employed therein and hence curtailing the amount of adsorbents used.

Another object of the invention is to provide an evaporative emission control system for internal combustion engines, which has a simplified construction involving a purging passage connecting between a canister and the intake system of the engine.

To attain the above objects, the present invention provides an evaporative emission control system for an internal combustion engine having an intake passage, and a fuel tank, including a canister for adsorbing evaporative fuel generated in the fuel tank, partition means partitioning an interior of the canister at least into a first adsorbent chamber and a second adsorbent chamber, a communication passage connecting between the first and second adsorbent chambers, a first introducing passage connected to the first adsorbent chamber, for introducing the evaporative fuel generated in the fuel tank into the first adsorbent chamber on an occasion other than at fueling, a purging passage connected to the first adsorbent chamber, for purging the evaporative fuel adsorbed in the canister into the intake passage of the engine, and an air-inlet passage connected to the second adsorbent chamber and communicating with the atmosphere.

The evaporative emission control system according to the invention is characterized by comprising:

- a second introducing passage connected to the second adsorbent chamber, for introducing the evaporative fuel generated in the fuel tank at refueling into the second adsorbent chamber;
- an additional passage connected to the first adsorbent chamber and communicating with the atmosphere, the second air-inlet passage having a cross sectional area larger than a cross sectional area of the first air-inlet passage;
- first valve means arranged across the first air-inlet passage, for closing the first air-inlet passage at refueling; and
- second valve means arranged across the second air-inlet passage, for opening the second air-inlet passage at refueling.

Preferably, the evaporative emission control system includes valve control means for controlling the first valve means, and wherein the first valve means is a normally-open electromagnetic valve.

Also preferably, the second valve means is a one-way valve which is opened by the pressure of the evaporative fuel from the canister at refueling.

Preferably, the first adsorbent chamber has a volumetric size larger than that of the second adsorbent chamber.

More preferably, the purging passage, the first and second introducing passages, the air-inlet passage and the additional passage have ends thereof connected to the canister at one side thereof, the communication passage being arranged at another side of the canister opposite the one side.

Advantageously, the adsorbent accommodated in the first adsorbent chamber and the adsorbent accommodated in the second adsorbent chamber are of substantially the same kind.

Alternatively, the adsorbent accommodated in the first adsorbent chamber and the adsorbent accommodated in the second adsorbent chamber have different adsorption characteristics from each other.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
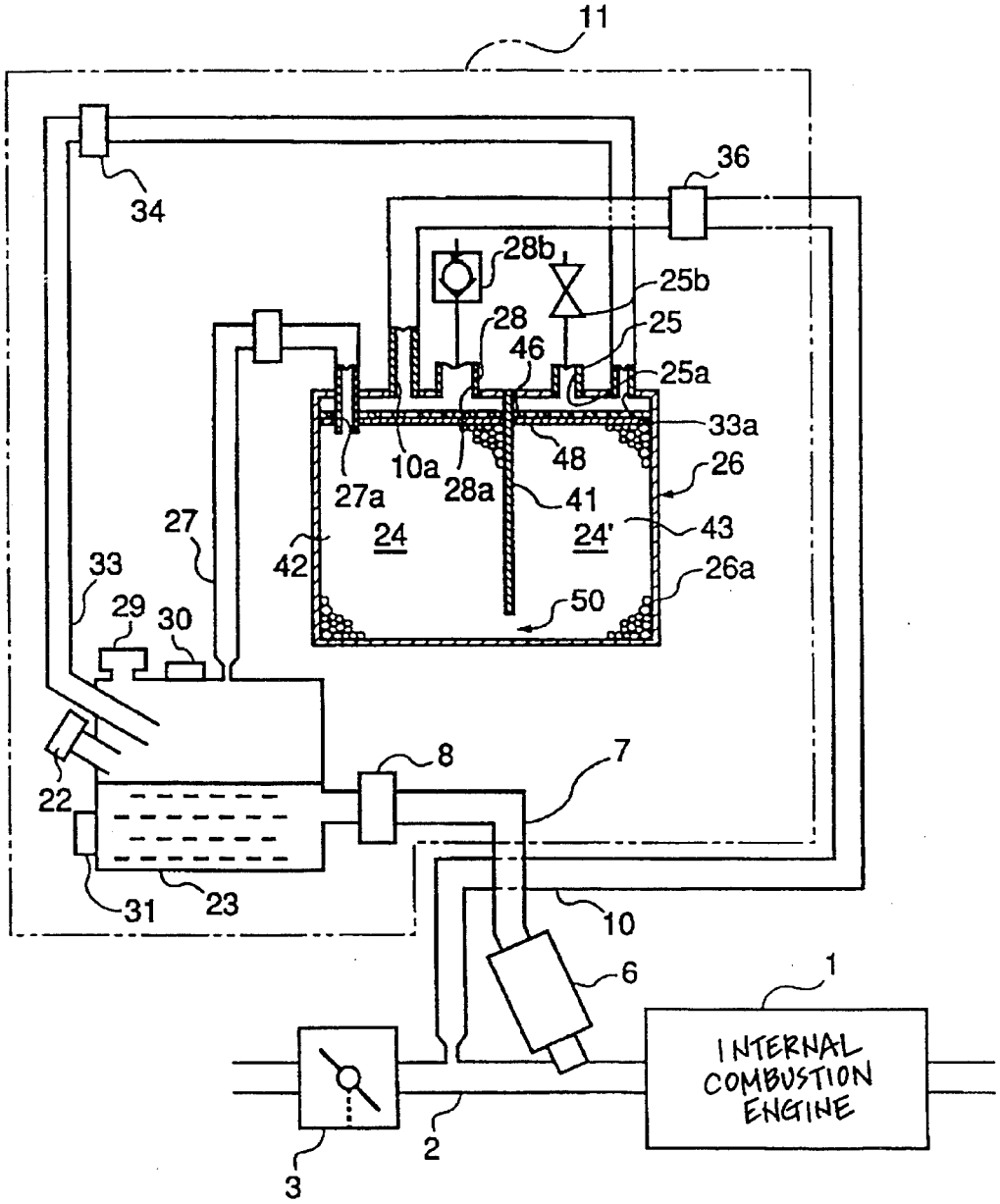
FIG. 1 is a schematic diagram showing-the whole arrangement of an evaporative emission control system for an internal combustion engine, according to an embodiment of the invention.

Referring first to FIG. 1, there is illustrated the whole arrangement of an internal combustion engine and an evaporative emission control system therefor, according to an embodiment of the invention. In the figure, reference numeral 11 designates an evaporative emission control system which operates to prevent emission of evaporative fuel generated in a fuel tank into the atmosphere. The evaporative emission control system 11 is comprised of a fuel tank 23 of an internal combustion engine 1, provided with a filler cap 22 which is opened at refueling, a canister 26 accommodating adsorbents 24 and 24' which are formed of activated carbon, a first charging passage (first introducing passage) 27 for operation on ordinary occasions, connecting between the canister 26 and the fuel tank 23, with an end thereof opening into an upper space in the fuel tank 23, a second charging passage (second introducing passage) 33 for operation at refueling, connecting between the canister 26 and the fuel tank 23, with an end thereof opening into a space in the fuel tank 23 in the vicinity of the filler cap 22, an electromagnetic valve 34 arranged across the second charging passage 33 for selectively opening and closing the same, a purging passage 10 connecting between the canister 26 and an intake pipe 2 of the engine 1, with an end thereof opening into the intake pipe 2 at a location downstream of a throttle valve 3, and a purge control valve 36 arranged across the purging passage 10 for selectively opening and closing the same. The electromagnetic valve 34 and the purge control valve 36 are controlled by control signals from an electronic control unit (ECU), not shown.

The canister 26 has a first activated carbon chamber (first adsorbent chamber) 42 and a second activated carbon chamber (second adsorbent chamber) 43 formed therein and partitioned from each other by a partition 41. The first and second activated carbon chambers 42, 43 are each defined by a canister casing **26*a*, a retainer plate 46, and the partition 41. The retainer plate 46 is formed of a porous material and has a filter 48 applied over an inner side surface thereof. The first activated carbon chamber 42 has a larger volumetric size than that of the second activated carbon chamber 43, and the first and second chambers 42 and 43 are densely charged, respectively, with the adsorbents 24, 24' which are formed of almost the same kind of activated carbon. The canister 26 has an inlet port 27*a* for use on ordinary occasions, an additional port 28*a*, and a discharge port 10*a*, which are provided in an upper portion of the canister 26 in or above the first activated carbon chamber 42, and connected, respectively, to the first charging passage 27, an additional passage 28 communicating with the atmosphere, and the purging passage 10. The inlet port 27*a* for use on ordinary occasions extends through the retainer plate 46 and the filter 48 to directly open into the activated carbon adsorbent 24. Further, the canister 26 has an inlet port 33*a* for use at refueling and an air-inlet port 25*a*, which are provided in an upper portion of the canister 26 above the second activated carbon chamber 43, and open into a gap defined between the casing 26*a* and the upper retainer plate 46. The inlet port 33*a* for use at refueling and the air-inlet port 25*a* are connected to the second charging passage 33 for use at refueling and a first air-inlet passage 25, respectively. The additional passage 28 extending from the first activated carbon chamber 42 is constructed so that its cross sectional area is larger than that of the first air-inlet passage 25 extending from the second activated carbon chamber 43. Further, the additional passage 28 and the first air-inlet passage 25 are provided with a one-way valve 28*b* and/a normally-open electromagnetic valve 25*b*, respectively, to have their operations controlled by signals from the ECU. A gap (communication passage) 50 is defined between a lower end of the partition 41 and the canister casing 26*a*, and through which the first and second activated carbon chambers 42, 43** communicate with each other.

Mounted in the intake pipe 2 at locations downstream of an end of the purging passage 10 opening into the intake pipe 2 are fuel injection valves 6 which are connected to the fuel tank 23 through a fuel supply pipe 7 and a fuel pump 8 arranged across the pipe 7. The fuel tank 23 is provided with a tank internal pressure sensor 29 and a fuel amount sensor 30, both mounted in an upper portion of the fuel tank 23 for sensing pressure in the fuel tank 23 and an amount of fuel in the fuel tank 23, respectively, as well as a fuel temperature sensor 31 mounted in a lateral side wall of the fuel tank 23 for sensing the temperature of fuel in the fuel tank 23.

Figure 2:
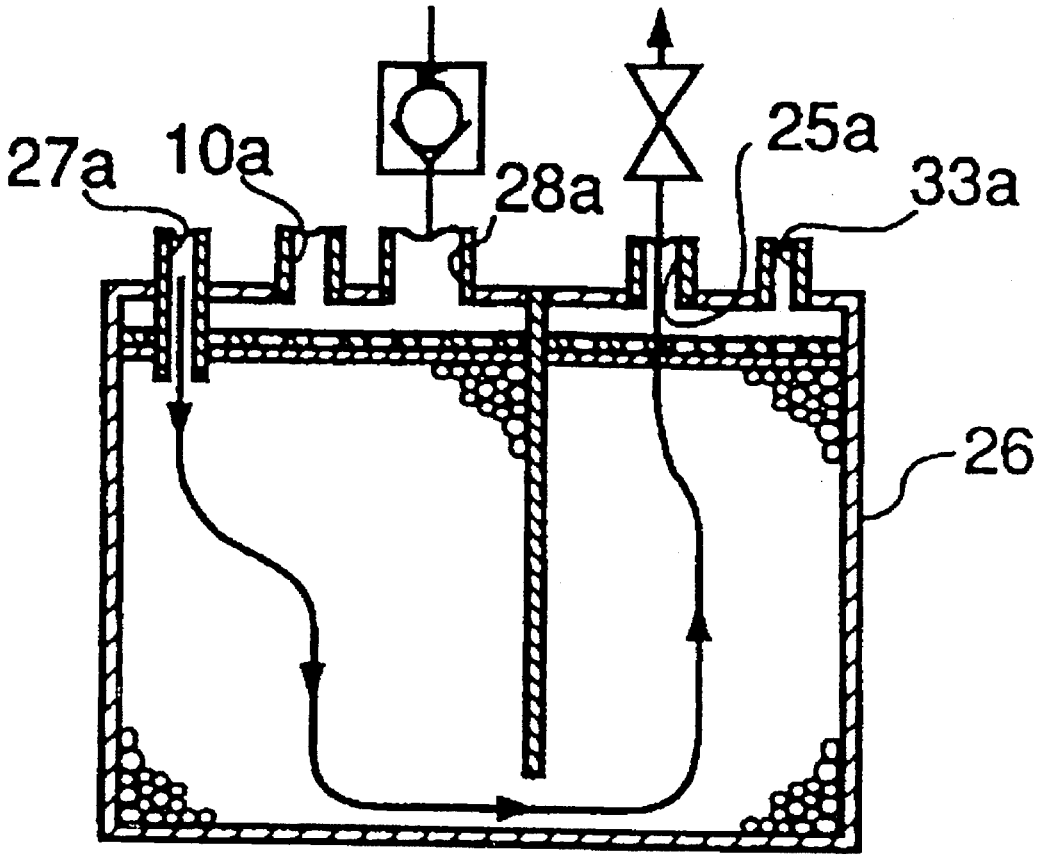
FIG. 2 is a sectional view of a canister appearing in FIG. 1, useful in explaining how evaporative fuel generated in a fuel tank flows in the canister on ordinary occasions, e.g. during parking of a vehicle in which the engine is installed, with the engine in stoppage, or during operation of the engine.

Description will be made as to how evaporative fuel is adsorbed into the canister 26 and purged therefrom in the evaporative emission control system constructed as above. First, adsorption and desorption (purging) of evaporative fuel carried out in the canister 26 will be described. FIG. 2 shows how evaporative fuel generated in the fuel tank 23 flows on an ordinary occasion, such as during parking of a vehicle with the engine in stoppage, or during operation of the engine. When the vehicle is parked with the engine being stopped or when the engine is operating, no driving signal is supplied from the ECU is supplied to the electromagnetic valve 34 to keep the same closed. Evaporative fuel generated in the fuel tank 23 is introduced through the first charging passage 27 for ordinary operations and the fuel port 27*a* into the first activated carbon chamber 42 in the canister 26. Then, most of the thus introduced evaporative fuel is adsorbed by the activated carbon adsorbent 24 accommodated in the first activated carbon chamber 42, while the remaining part of the evaporative fuel overflowing the first activated carbon chamber 42 is introduced through the gap 50 formed below the partition 41 into the second activated carbon chamber 43, where the evaporative fuel is adsorbed by the activated carbon adsorbent 24'. Since on this occasion no driving signal from the ECU is supplied to the electromagnetic valve 34 to keep it closed, there occurs no backflow of evaporative fuel from the canister 26 to the fuel tank 23 through the second charging passage 33 for use at refueling. Further, on this occasion, the one-way valve 28*b* remains closed to close the additional passage 28*a*, there positively occurs a serial flow of evaporative fuel through the canister 26. Since evaporative fuel thus flows serially through the first activated carbon chamber 42, the communication passage 50, and the second activated carbon chamber 43 on ordinary occasions, the substantial size ratio L/D of the canister 26 can be increased, whereby it is prevented that evaporative fuel passes through the canister 26 without being adsorbed thereby.

Figure 3:
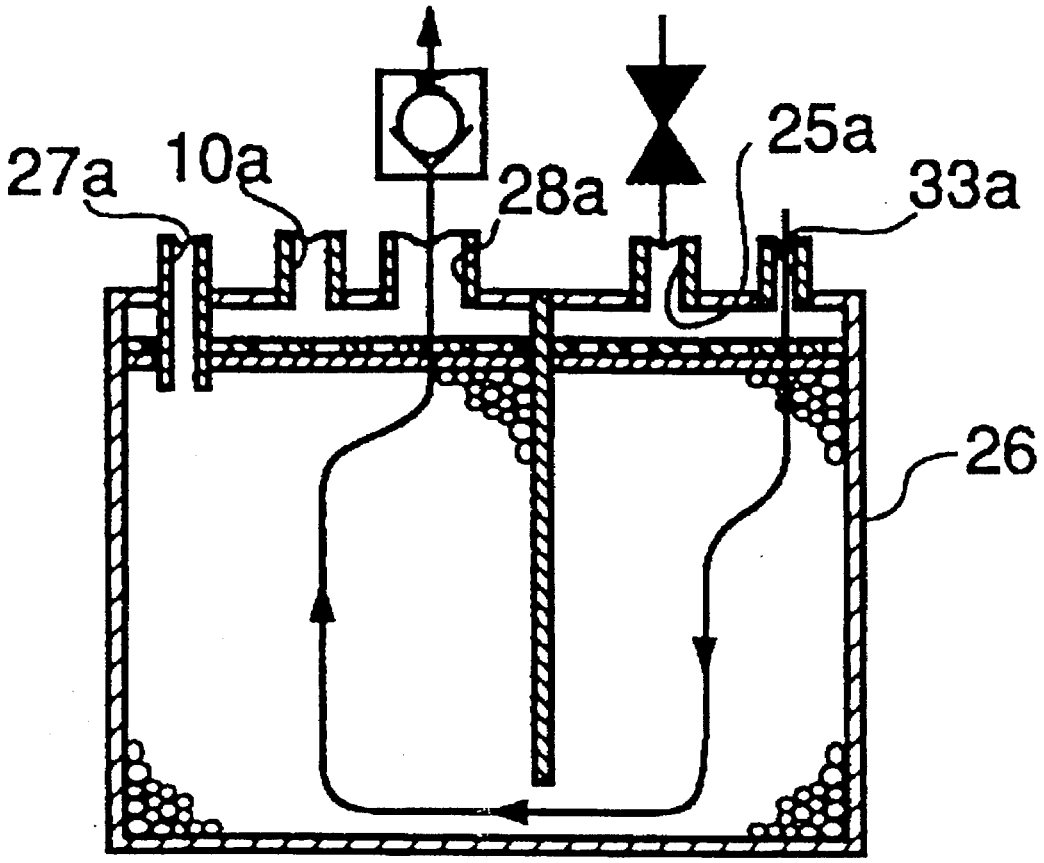
FIG. 3 is a similar view to FIG. 2, useful in explaining how evaporative fuel generated in the fuel tank flows in the canister during refueling.

Next, how evaporative fuel generated in the fuel tank 23 flows at refueling will be described with reference to FIG. 3. At refueling, the electromagnetic valve 34 is opened by a driving signal from the ECU, while the normally-open electromagnetic valve 25*b* is closed by a driving signal from the ECU. Then, evaporative fuel vigorously generated in large quantities in the fuel tank 23 at refueling is guided through the charging passage 33 for use at refueling with an end thereof opening into the fuel tank 23 in the vicinity of the filler cap 22, to the inlet port 33*a* for use at refueling, provided in the upper portion of the canister 26. Then, the pressure of the evaporative fuel flowing from the inlet port 33*a* into the second activated carbon chamber 43 is transmitted via the communication passage 50, the first activated carbon chamber 42, the additional port 28*a* to the one-way valve 28*b* of the additional passage 28, to thereby forcibly open the valve 28. The evaporative fuel having vigorously flown into the second activated carbon chamber 43 at refueling is adsorbed by the adsorbents 24' and 24 within the second and first activated carbon chambers 43 and 42, respectively, while the remaining part of the evaporative fuel which is not adsorbed is emitted into the air through the additional port 28*a* and the additional passage 28. Thus, the flow of evaporative fuel at refueling is reverse to that on an ordinary occasion, and therefore evaporative fuel can be evenly adsorbed by the whole adsorbents 24 and 24'.

Figure 4:
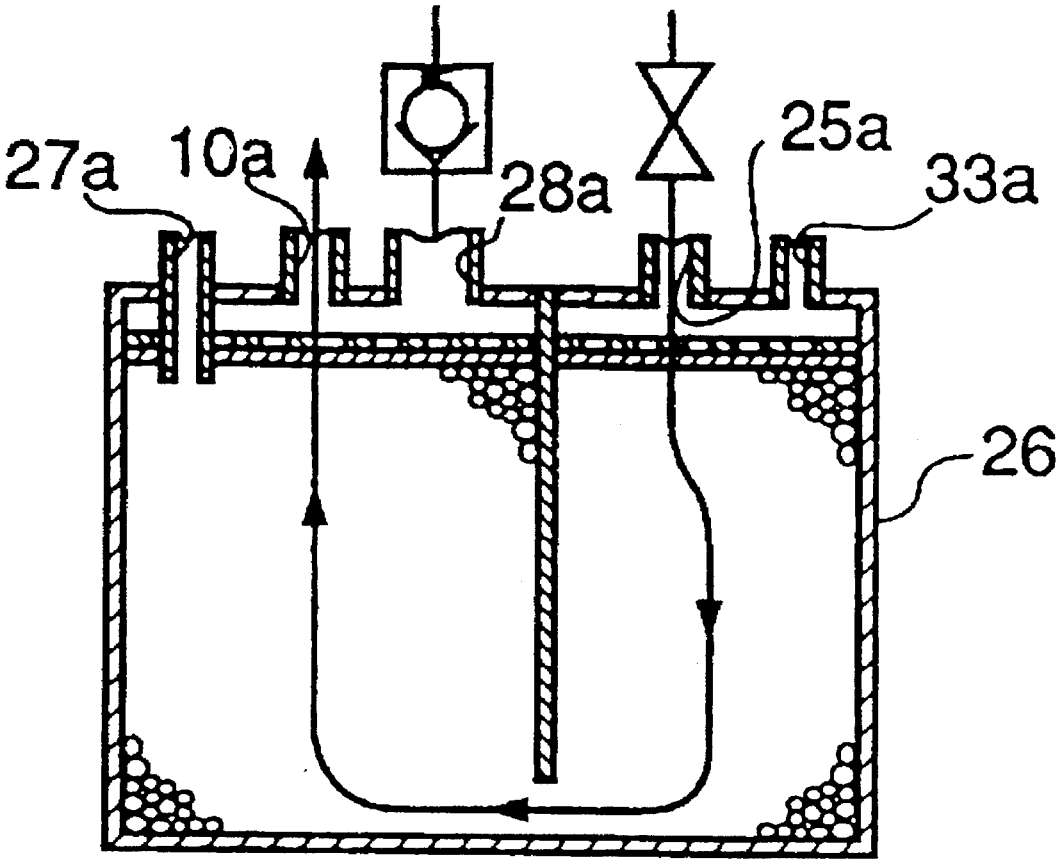
FIG. 4 is a similar view to FIG. 2, useful in explaining how evaporative fuel flows within the canister during purging.

Next, how evaporative fuel is desorbed from the canister 26 and purged into the engine will be described. FIG. 4 shows a flow of evaporative fuel occurring in the canister 26 during purging from the canister 26. To start purging, a driving signal from the ECU is supplied to the purge control valve 36 arranged across the purging passage 10, to thereby open the valve 36. Purging of evaporative fuel is carried out when the engine 1 is in a predetermined operating condition. When the engine 1 is in such a predetermined operating condition, vacuum is developed in the intake pipe 2, which is transmitted through the purging passage 10 with the purge control valve 36 being open, into the first activated carbon chamber 42 in the canister 26, and then through the gap 50 into the second activated carbon chamber 43. Consequently, fresh air is introduced from the outside into the second activated carbon chamber 43 through the first air-inlet passage 25 and the air-inlet port 25*a*, whereby evaporative fuel is desorbed from the adsorbent 24' due to the flowing-in air, and a mixture of the desorbed evaporative fuel and the air flows through the gap 50 into the first activated carbon chamber 42. Then, also evaporative fuel adsorbed by the adsorbent 24 in the first activated carbon chamber 42 is desorbed from the latter, and the resulting mixture of the evaporative fuel and air is guided through the purging passage 10 into the intake pipe 2 to be drawn into the engine 1.

As described above, according to the present embodiment, both on ordinary occasions and at refueling, evaporative fuel generated in the fuel tank 23 is adsorbed by the activated carbon adsorbents 24, 24' in the respective first and second activated carbon chambers 42, 43 of the canister 26. As a result, the utilization factor of the adsorbents 24, 24' can be increased. Besides, since the flow of evaporative fuel on an ordinary occasion is reverse to that at refueling, the whole adsorbents 24 and 24' can be efficiently used. Therefore, as compared with the conventional arrangement wherein activated carbon adsorbents are accommodated in separate canisters for operation, respectively, at refueling and on ordinary occasions, the amount of activated carbon to be used can be curtailed. Further, according to the embodiment, the single purging passage 10 is provided, which simplifies the construction, as compared with the conventional arrangement wherein two or more purging passages are provided. Still further, since the volumetric size of the first activated carbon chamber 42 is made larger than that of the activated carbon chamber 43, the HC concentration in the former is reduced below that in the latter, which, together with the U-shaped flow of evaporative fuel in the canister, acts to eliminate occurrence of the equilibrium adsorption phenomenon in the canister 26, whereby the HC component is effectively adsorbed by the adsorbents 24 and 24' and hence it is prevented that evaporative fuel passes through the canister 26 without being adsorbed thereby. Moreover, since the cross sectional area of the additional passage 28 is made larger than that of the first air-inlet passage 25, the flow resistance at refueling is reduced, to thereby enabling smooth refueling.

Although in the present embodiment, the first and second activated carbon chambers 42 and 43 accommodate almost the same kind of activated carbon adsorbents 24 and 24', respectively, different kinds of activated carbon may be employed. Besides, the activated carbon chambers may accommodate activated carbons which are different in adsorption characteristics from each other. For example, they may accommodate activated carbons which have different properties, e.g. different adsorption characteristics, depending upon evaporative fuel components required to be adsorbed. More specifically, for example, an activated carbon chamber into which evaporative fuel first flows, e.g. the first activated carbon chamber, may accommodate an activated carbon which adsorbs well evaporative fuel component having relatively high boiling points, while the second activated carbon chamber may accommodate an activated carbon which adsorbs well evaporative fuel components having relatively low boiling points.

What is claimed is:

1. In an evaporative emission control system for an internal combustion engine having an intake passage, and a fuel tank, including a canister for adsorbing evaporative fuel generated in said fuel tank, partition means partitioning an interior of said canister at least into a first adsorbent chamber and a second adsorbent chamber, a communication passage connecting between said first and second adsorbent chambers, a first introducing passage connected to said first adsorbent chamber, for introducing said evaporative fuel generated in said fuel tank into said first adsorbent chamber on an occasion other than at refueling, a purging passage connected to said first adsorbent chamber, for purging said evaporative fuel adsorbed in said canister into said intake passage of said engine, and an air-inlet passage connected to said second adsorbent chamber and communicating with the atmosphere, the improvement comprising:

a second introducing passage connected to said second adsorbent chamber, for introducing said evaporative fuel generated in said fuel tank at refueling into said second adsorbent chamber;

an additional passage connected to said first adsorbent chamber and communicating with the atmosphere, said additional passage having a cross sectional area larger than a cross sectional area of said air-inlet passage;

first valve means arranged across said air-inlet passage, for closing said air-inlet passage at refueling; and second valve means arranged across said additional passage, for opening said additional passage at refueling.

2. An evaporative emission control system as claimed in claim 1, including valve control means for controlling said first valve means, and wherein said first valve means is a normally-open electromagnetic valve.

3. An evaporative emission control system as claimed in claim 1, wherein said second valve means is a one-way valve which is opened by pressure of said evaporative fuel from said canister at refueling.

4. An evaporative emission control system as claimed in claim 1, wherein said first adsorbent chamber has a volumetric size larger than that of said second adsorbent chamber.

5. An evaporative emission control system as claimed in claim 1, wherein said purging passage, said first and second introducing passages, said air-inlet passage and said additional passage have ends thereof connected to said canister at one side thereof, said communication passage being arranged at another side of said canister opposite said one side.

6. An evaporative emission control system as claimed in claim 1, wherein said adsorbent accommodated in said first adsorbent chamber and said adsorbent accommodated in said second adsorbent chamber are of substantially the same kind.

7. An evaporative emission control system as claimed in claim 1, wherein said adsorbent accommodated in said first adsorbent chamber and said adsorbent accommodated in said second adsorbent chamber have different adsorption characteristics from each other.

* * * * *